US006446677B1

(12) United States Patent
Cheng

(10) Patent No.: US 6,446,677 B1
(45) Date of Patent: Sep. 10, 2002

(54) WEFT CONTROLLING DEVICE FOR USING WEFT AS WARP IN A STRAP WEAVING MACHINE

(75) Inventor: Cheng-Hsiung Cheng, Taipei Hsien (TW)

(73) Assignee: Chen-Hui Lin, Taoyuan Hsien (TW)

( * ) Notice: Subject to any disclaimer, the term of this patent is extended or adjusted under 35 U.S.C. 154(b) by 0 days.

(21) Appl. No.: 10/112,875

(22) Filed: Apr. 2, 2002

(51) Int. Cl.[7] ..... D03D 47/39

(52) U.S. Cl. ..... 139/116.1; 139/48; 139/117; 139/118; 139/432; 139/22

(58) Field of Search ..... 139/48, 116.1, 139/117, 118, 432, 22

(56) References Cited

U.S. PATENT DOCUMENTS 4,640,317 A * 2/1987 Chardon et al. ..... 139/431
5,892,486 A * 4/1999 Cook et al. ..... 343/795
6,112,775 A * 9/2000 Hossli et al. ..... 139/383 R

* cited by examiner

*Primary Examiner*—Andy Falik
(74) *Attorney, Agent, or Firm*—Fei-Fei Chao; Venable, Baetjer, Howard & Civiletti, LLP

(57) ABSTRACT

A weft controlling device for using weft as warp in a strap weaving machine has motors mounted on an assembly board and controlling rods each movably connected to a corresponding one of the motors by a controlling thread and each controlling rod having a weft hole in a distal end thereof so as to allow weft to pass through the weft hole. Springs are each mounted around a corresponding one of the controlling rods to provide a recovery force to the corresponding controlling rod. The movement of the controlling rods by the motors is able to drive the weft to a specific position for selection by the strap weaving machine.

10 Claims, 6 Drawing Sheets

WEFT CONTROLLING DEVICE FOR USING WEFT AS WARP IN A STRAP WEAVING MACHINE

BACKGROUND OF THE INVENTION

1. Field of the Invention

The present invention relates to a controlling device, and more particularly to a weft controlling device for using weft as warp in a strap weaving machine. The controlling device has controlling rods each having a warp passing therethrough so that when a certain quantity of the controlling rods are selected, the warp passing through the selected controlling rods are then able to be used as the weft.

2. Description of Related Art

Weaving technology for strap weaving machines has been developed for centuries. To have diversities in the woven patterns, different controlling devices for controlling the warp or the weft have been available in the market. Basically, a striped strap is woven by colorful warp. If the weft is also colorful, the woven fabric (the strap) becomes a checkered strap. As we all know, the checkered strap may contain different colors and patterns. In order to present the checkered straps with different patterns, weft controlling device plays a crucial role. The conventional weft controlling device is composed of an operation chain in combination with a disk. When the user wants to change the color of the weft, which involves e.g., 120 stitches in a complete cycle for changing the color, the operation chain will have the corresponding quantity of knots. Therefore, whenever there is a need for changing the color of the weft, the user will have to go through a lot of effort to change the configuration of the operation chain. After the configuration of the operation chain is determined, the operation chain in combination of the disk can only be used to weave the specific checkered strap.

Another approach to solve the complexity of the existing problem in making the checkered strap is to use a controlling device to control the movement of the weft. However, when the controlling device is activated, the checkered strap will encounter a problem of having frayed side faces. Therefore, a heating method is adopted to eliminate the frayed side faces of the produced checkered strap, which utilizes the convergence of the heated frayed side faces of the checkered strap to be hidden inside the edge of the checked strap. This method solves the existing problem though it still has the difficulty of simplifying the entire structure of the weaving machine.

To overcome the shortcomings, the present invention tends to provide a weft controlling device to mitigate and obviate the aforementioned problems.

SUMMARY OF THE INVENTION

The primary objective of the present invention is to provide a weft controlling device for using weft as warp so as not only to simplify the structure of the strap weaving machine, but also to accomplish the desired goal.

In order to accomplish the foregoing objective, the weft controlling device has controlling rods each having a weft coming from a spindle and passing therethrough. When a specific weft is chosen, the corresponding controlling rod is moved to a position so as to be woven into the fabric and the remaining weft will be woven into the fabric as warp.

Another objective of the invention is that each of the controlling rods is controlled by an individual motor which may be a step motor or a server motor.

Other objects, advantages and novel features of the invention will become more apparent from the following detailed description when taken in conjunction with the accompanying drawings.

DETAILED DESCRIPTION OF THE PREFERRED EMBODIMENT

Figure 1:
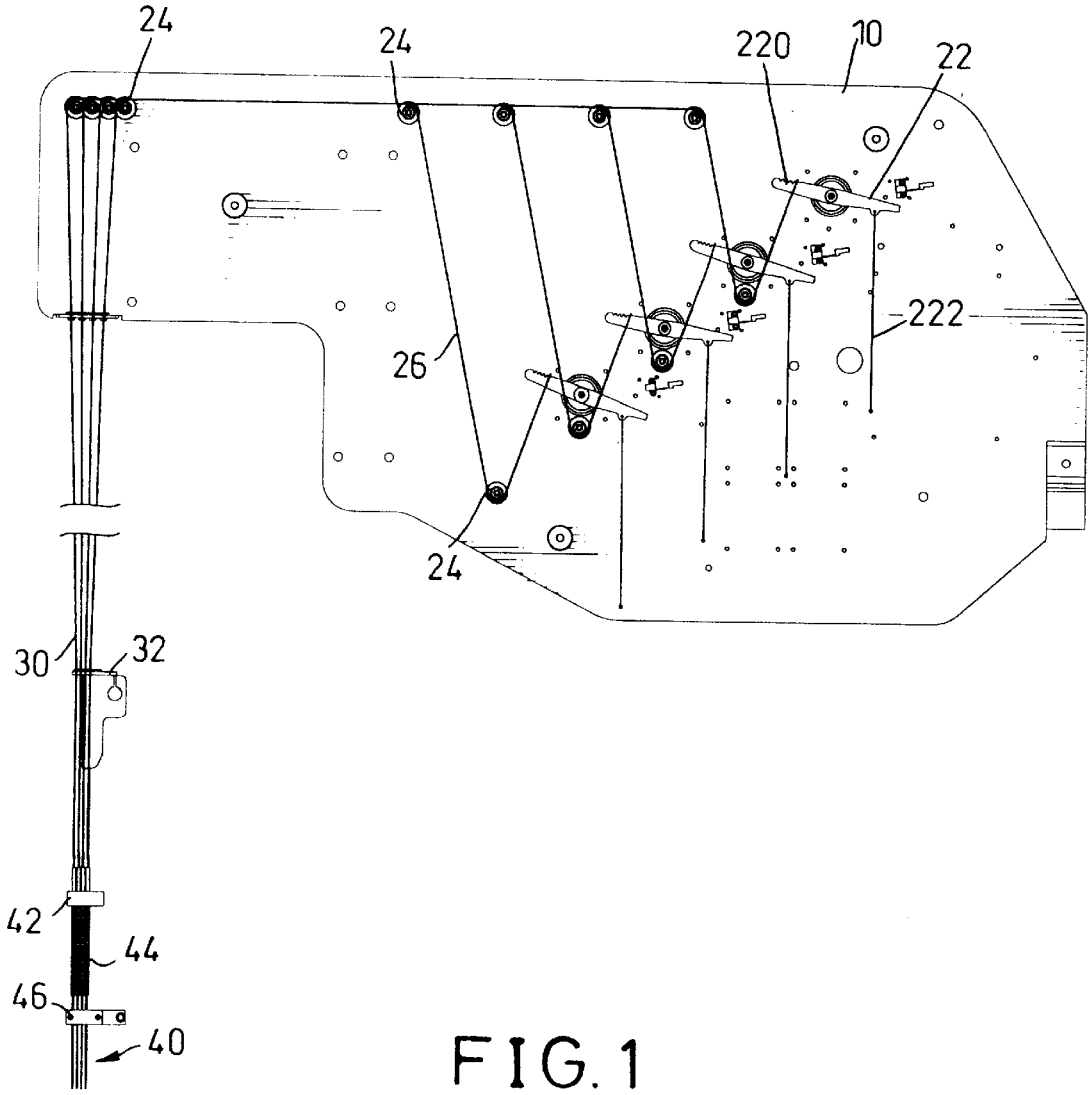
FIG. 1 is a schematic plan view showing the structure of the weft controlling device of the present invention.
Figure 2:
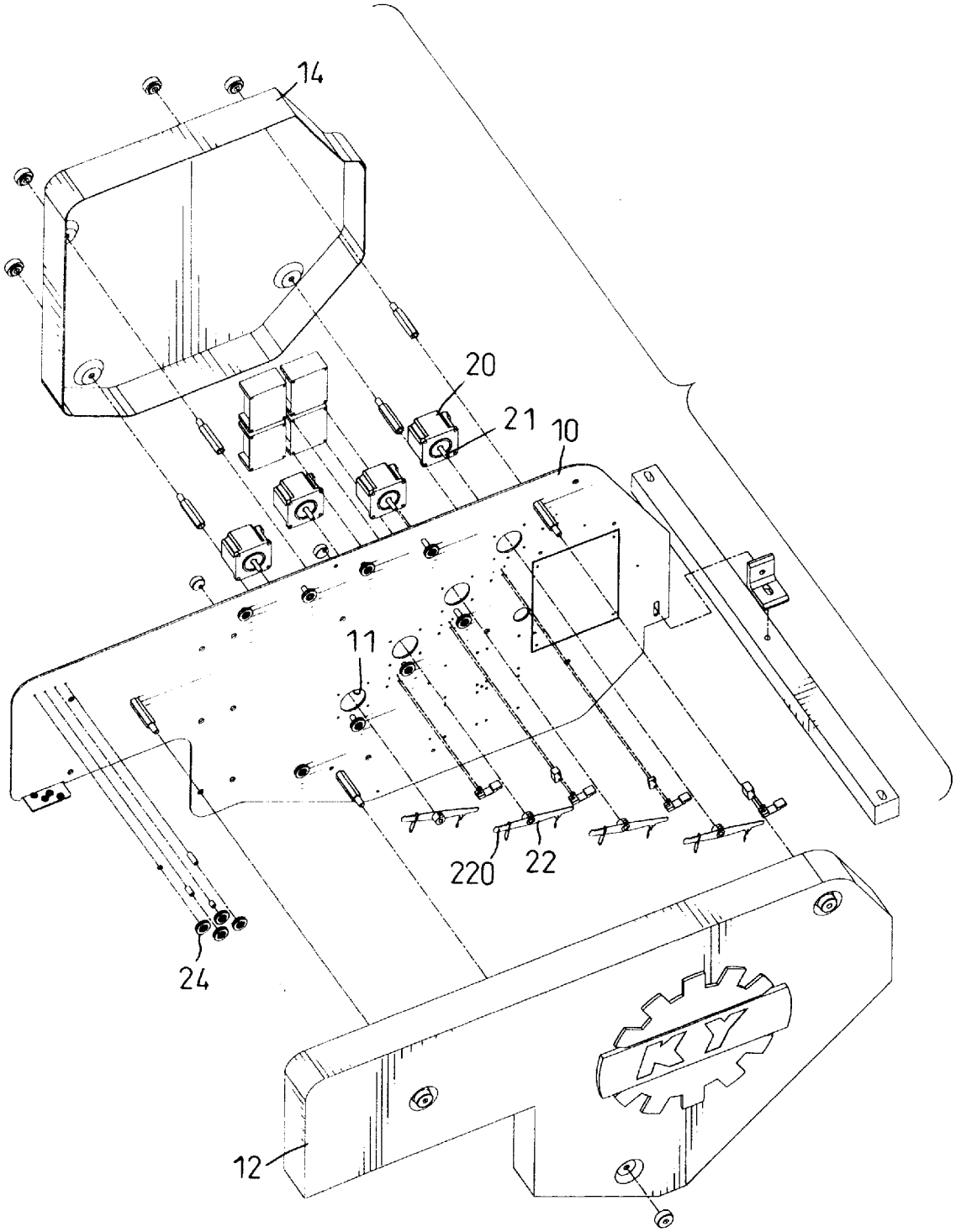
FIG. 2 is an exploded perspective view showing the parts mounted on an assembly board.

With reference to FIGS. 1 and 2, the weft controlling device in accordance with the present invention has an assembly board (10), motors (20), controlling threads (30) and controlling rods (40).

The assembly board (10) has multiple holes (11) defined therethrough for mounting the motors (20) thereon, a front casing (12) and a rear casing (14) together with the front casing (12) to partially enclose the assembly board (10).

Each motor (20) is mounted on the assembly board (10) and has a motor shaft (21) extending out from a side of the assembly board (10) to be connected to a controlling lever (22). A first end face formed on top of the controlling lever (22) is provided with teeth (220) and a second end face oppositely formed on a bottom of the controlling lever (22) is connected to a first distal end of a resilient element (222). A second distal end of the resilient element (222) is positioned on the assembly board (10). The teeth (220) are provided for connecting with a first distal end of an operation thread (26). The assembly board (10) further has sets of guiding wheels (24), each set of guiding wheels (24) being securely yet rotatably mounted on the assembly board (10) to correspond to one of the operation threads (26). It is noted from the drawing that each set of the guiding wheels (24) contains three guiding wheels (24) each being so, positioned as to guide the corresponding operation thread (26) to a specific location. A second distal end of the operation thread (26) is connected to a first distal end of a controlling thread (30). Because the connection between the operation thread (26) and the controlling thread (30) is conventional and is irrelevant to the essence of the present invention, the following detailed description gives no credit as to how the operation thread (26) and the controlling thread (30) are connected with each other.

Figure 3:
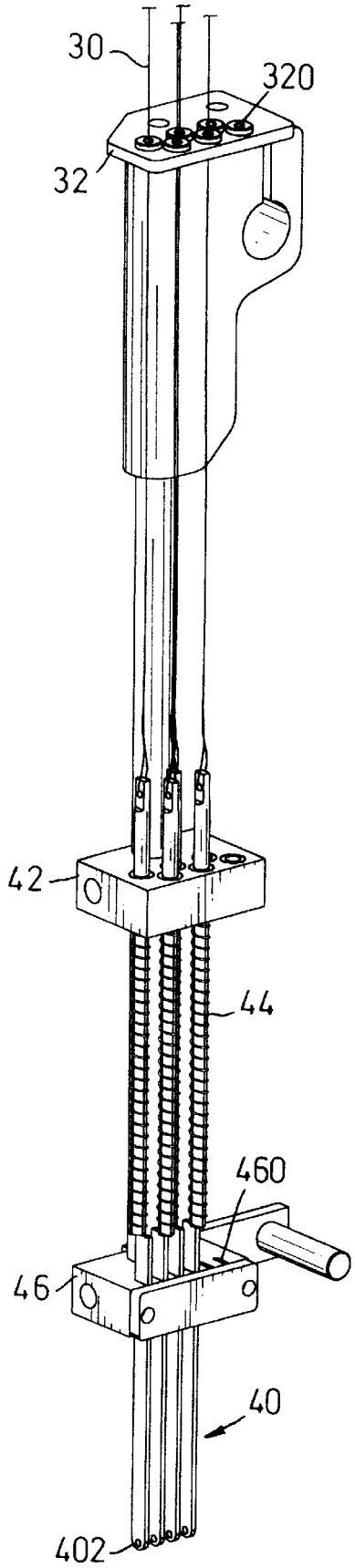
FIG. 3 is a perspective view showing the controlling rods in combination with the controlling threads.

With reference to FIG. 3, it is seen that four controlling threads (30) pass through four corresponding controlling holes (320) in a controlling board (32). After passing through the corresponding controlling holes (320), each of the four controlling threads (30) connects to a first distal end of a controlling rod (40).

The first distal end of the controlling rod (40) extends through a guiding board (42) to connect to a corresponding one of the controlling threads (30). A second distal end of each of the controlling threads (40) extends through a corresponding one of guiding holes (460) in a guiding plate (46) to allow the weft coming from a spindle (not shown) to extend through a weft hole (402) in the second distal end of the controlling rod (40). Each controlling rod (40) has a spring (44) mounted therearound. A first distal end of the springs (44) is securely mounted on the corresponding controlling rod (40) and a second distal end of the springs (44) abuts a bottom face of the guiding board (42) so that when a specific controlling rod (40) is moved, the corresponding spring (44) will provide the controlling rod (40) a recovery force so as to return the controlling rod (40) back to its original position.

Figure 4:
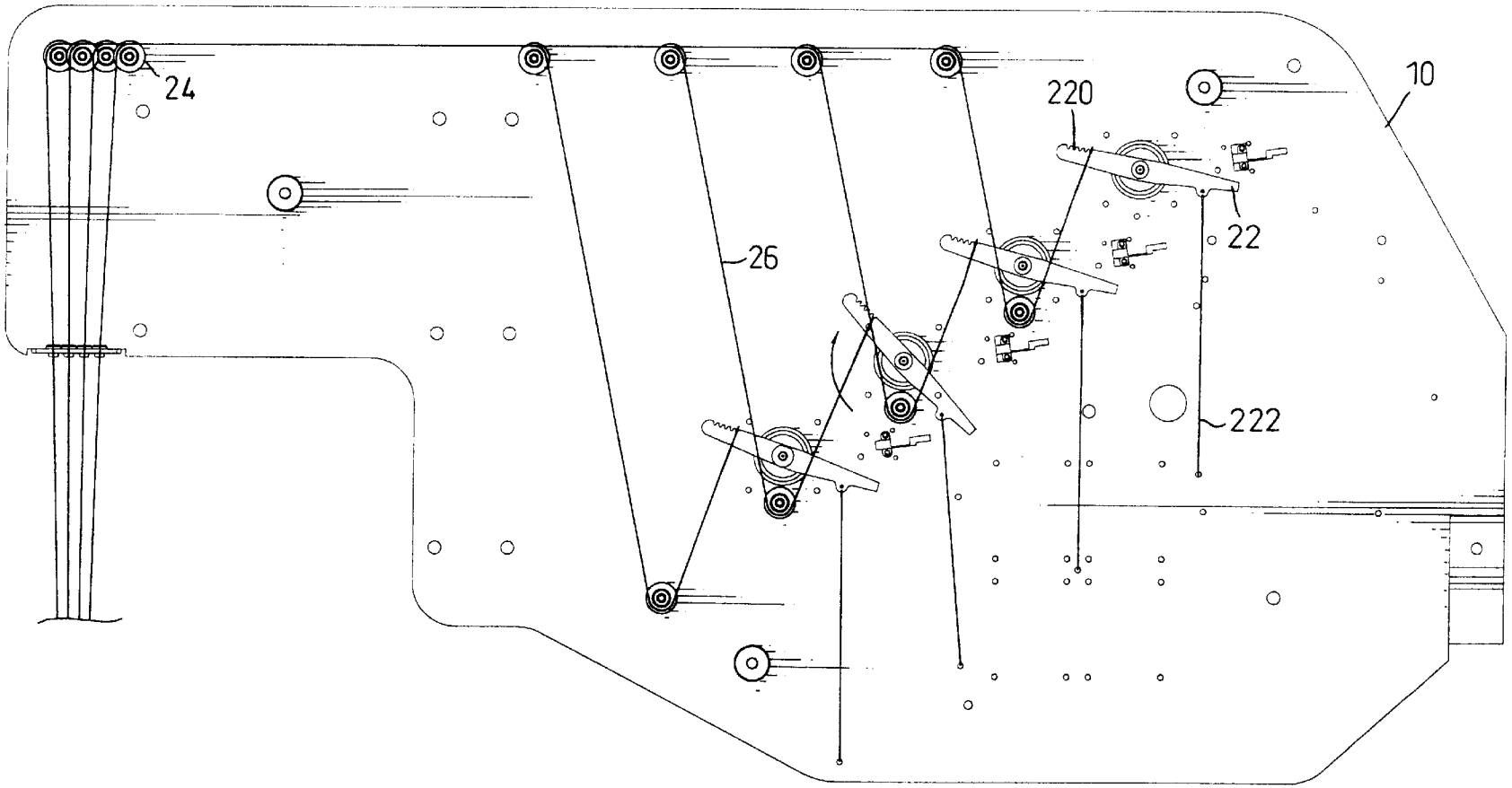
FIGS. 4 and 5 are a schematic views showing the relative operation on the assembly board and the controlling rods.
Figure 5:
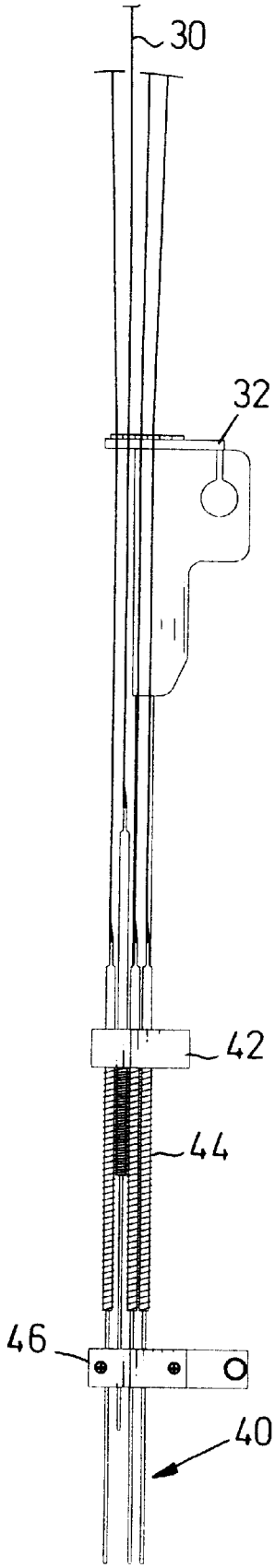

With reference to FIGS. 4 and 5, the weft controlling device is controlled to move simultaneously and synchronously with the heddle. Due to the control mechanism being not the focus of the present invention, there will be no further description about how the weft controlling device is moving synchronously with the heddle.

When a specific controlling rod (40) is selected, as shown in FIG. 5, the selected controlling rod (40) is lifted, which loosens the tension on the controlling operation thread (26). Accordingly, the corresponding controlling lever (22) will tilt to a certain angle for picking out by a weft weaving mechanism.

Figure 6:
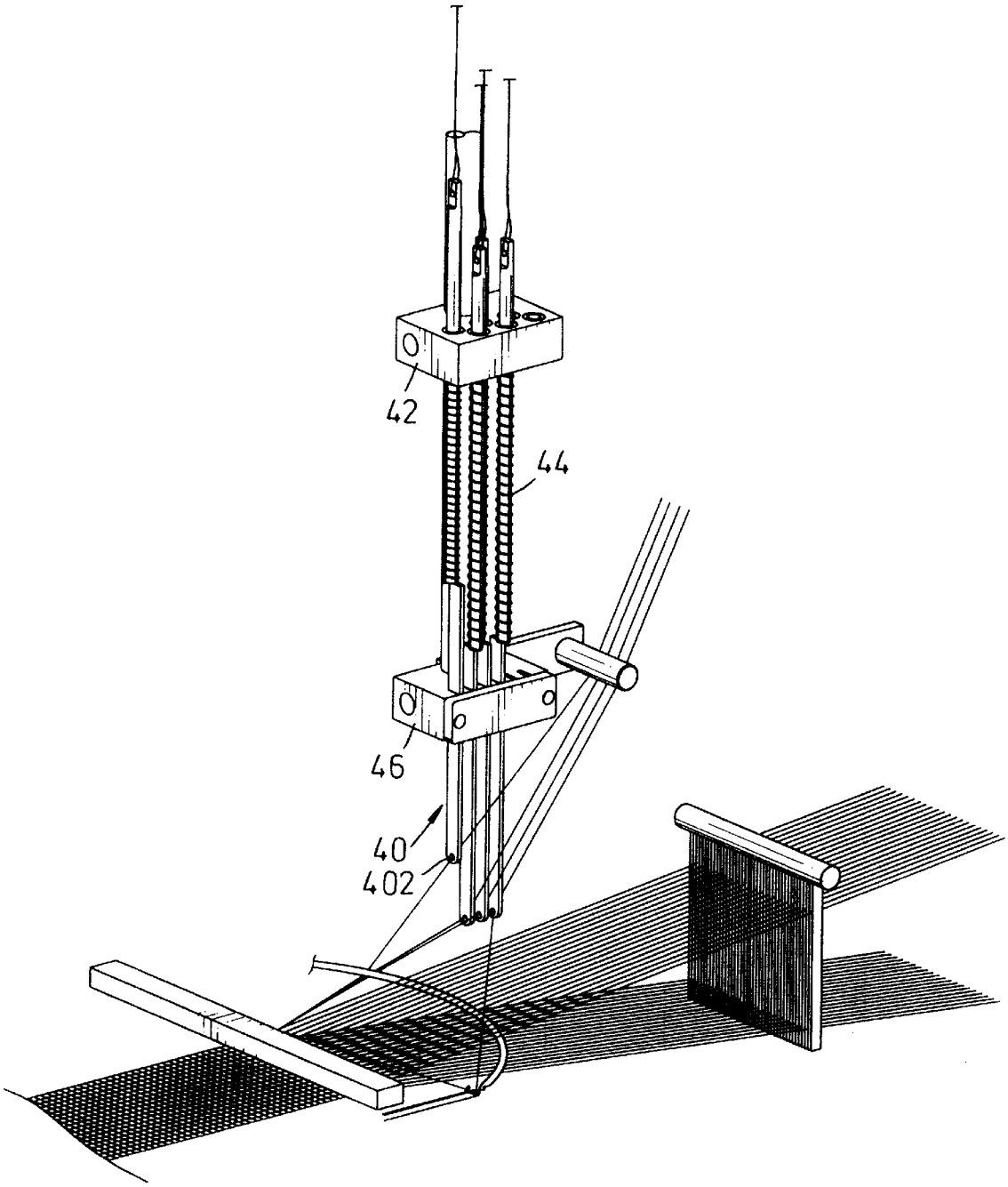
FIG. 6 is a perspective view showing the application of the weft controlling device of the present invention.

With reference to FIG. 6, it is notable that when a specific controlling rod (40) is selected and is moved upward relative to the guiding plate (46), the weft passing through the weft hole (402) in the second distal end of the controlling rod (40) is also lifted, such that the weft controlling mechanism is able to use the selected weft to change the pattern of the checked strap. That is, if there are two controlling rods (40) each carrying a weft of a color are selected, when the weft controlling mechanism uses these two wefts, the woven strap will not be the same as the strap woven by only one weft. It is also noted that when the controlling rods (40) are not selected, all the wefts passing through the controlling rods (40) are used as warp woven into the strap (not shown).

With the foregoing weft controlling device of the present invention, the selvedge of the strap is smooth and because the controlling rods (44) are able to be easily chosen to meet different requirements, the operation of the strap weaving machine is greatly simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A weft controlling device for using weft as warp in a strap weaving machine, the weft controlling device comprising:

motors mounted on an assembly board;

controlling rods each movably connected to a corresponding one of the motors by a controlling thread and each controlling rod having a weft hole in a distal end thereof so as to allow weft to pass through the weft hole; and springs each mounted around a corresponding one of the controlling rods to provide a recovery force to the corresponding controlling rod, whereby movement of the controlling rods by the motors is able to drive the weft to a specific position for selection by the strap weaving machine.

2. The weft controlling device as claimed in claim 1 further comprising an assembly board for mounting thereon the motors.

3. The weft controlling device as claimed in claim 2, wherein the assembly board further has a front casing and a rear casing together with the front casing to partially enclose the assembly board.

4. The weft controlling device as claimed in claim 2, wherein each motor has a motor shaft extending out from a side of the assembly board to connect to a controlling lever, the controlling lever having a first end connected to a resilient element positioned on the assembly board and a second end provided with teeth for connection with a first end of an operation thread, a second end of the operation thread connected to a corresponding one of the controlling threads.

5. The weft controlling device as claimed in claim 4, wherein the assembly board has sets of guiding wheels rotatably mounted on the assembly board.

6. The weft controlling device as claimed in claim 4, wherein each controlling thread passes through a corresponding one of controlling holes in a controlling board.

7. The weft controlling device as claimed in claim 6, wherein each controlling rod extends through a corresponding one of guiding holes in a guiding plate to connect to a distal end of the controlling thread.

8. The weft controlling device as claimed in claim 7, wherein a first end of the spring abuts a bottom face of the controlling board and a second end of the spring is securely mounted on the corresponding one of the controlling rods.

9. The weft controlling device as claimed in claim 8, wherein the motor is a step motor.

10. The weft controlling device as claimed in claim 8, wherein the motor is a server motor.

* * * * *